United States Patent [19]

Jonelis et al.

[11] Patent Number: 4,840,649

[45] Date of Patent: Jun. 20, 1989

[54] ADJUSTABLE BUTTRESS FOR USE IN AN ELECTROSTATIC PRECIPITATOR

[75] Inventors: John A. Jonelis, Crystal Lake; John I. Bata, Algonquin, both of Ill.

[73] Assignee: Midwest Power Corporation, Rolling Meadows, Ill.

[21] Appl. No.: 221,345

[22] Filed: Jul. 19, 1988

[51] Int. Cl.[4] ..... B03C 3/04

[52] U.S. Cl. ..... 55/140; 55/154; 410/124; 410/128

[58] Field of Search ..... 55/140, 141, 143, 147, 55/154; 248/231.2; 410/127, 128, 124

[56] References Cited

U.S. PATENT DOCUMENTS

| | | | |
|---|---|---|---|
| 2,252,383 | 8/1941 | Brase | 410/124 |
| 2,885,221 | 5/1959 | Weeks | 410/128 |
| 3,430,922 | 3/1969 | Spencer | 410/124 |
| 4,519,818 | 5/1985 | Jonelis | 55/154 |

*Primary Examiner*—Bernard Nozick

*Attorney, Agent, or Firm*—Anthony S. Zummer

[57] ABSTRACT

This invention relates to an adjustable buttress for use in an electrostatic precipitator for spacing an end plate from a portion of a precipitator housing. The adjustable buttress is selectively positionable between a portion of an electrostatic precipitator housing and an end plate which is on one end of a plurality of plates in the electrostatic precipitator. The adjustable buttress engages the end plate for positioning the end plate a selected distance from the housing. The adjustable buttress includes an axle. A pair of arms is pivotally mounted on the axle. A rail is connected to each of the arms, and a buttress contact is mounted on each of the rails. The buttress contacts define a contact plane. A positioning device is connected to the rails for selectively moving the rails relative to each other to determine selectively the distance between the rails and thereby the distance between the axle and the contact plane for selectively holding the end plate a selected distance from the housing.

24 Claims, 3 Drawing Sheets

94
26
98
86
22
88
102
80
28
82
20
104
24
52
118
40
50
84
96
90
92
14
48
57
42
44
36
38
110
12
30
110
100
76
72
10
64
46
66
106
36
34
56
16
58
62
59
18
60
54
74
106
68
70
78

112
116
82
120
118
84
110

42
36
30
57
42
48
32
36

ADJUSTABLE BUTTRESS FOR USE IN AN ELECTROSTATIC PRECIPITATOR

BACKGROUND OF THE INVENTION

An electrostatic precipitator is commonly used to remove fine particulate matter from a gas stream. An electrostatic precipitator is commonly used in the power generating industry to remove particulate from combustion products from a boiler before gaseous products of combustion enter a smokestack. There are also a wide variety of other uses for removing particulate produced in an industrial process, such as, in a paper mill, cement plant, chemical plant, or a steel plant. A conventional and well known construction for electrostatic precipitators is one which includes a plurality of large flat steel plates. Each of the plates typically has a length of twenty feet or more and has a width of six feet or more. The plates are hung from supports with the length of each plate being in the vertical direction. The plates or panels or curtains as they are sometimes called are equidistantly spaced from each other and are parallel to each other. Each plate also has a plurality of stiffeners which extend the length of the plate to keep the respective plate flat. A plurality of electrodes is positioned between adjacent plates. The electrodes typically are wires which are hung from a frame and extend the entire length of the plates. Other devices are used for electrodes in lieu of wires, such as, pipes with sharp nails attached, coiled wire, metal rod, flat wire with or without barbs, and a variety of other constructions, all of which share the common feature of a sharp point. Ordinarily, when wires are used, weights are hung on the bottom of the wires and the movement of the weights is restrained in some manner to eliminate undue swaying of the wire. A housing encloses the plates and the wires. The housing is connected to the source of gaseous material with particulate and opens into a conventional conduit for carrying away the exhaust gaseous material such as a smokestack.

The gaseous material with particulate matter flows between the plates across the surface of the plates. The wires are electrically charged with one charge so that the particulate matter carried by the gaseous material becomes charged and is attracted to the plates which are charged with a charge opposite to that of the charge on the wires. The charged particulate matter collects on the plates and is held onto the plates by the charge on the plates. Thus, the gaseous material passes the plates and has the particulate matter removed therefrom.

In a typical operation of an electrostatic precipitator, the particulate matter collected on the plates is intermittently removed from the plate. The plates are vibrated in some manner, such as, being rapped with a hammer to dislodge the particulate matter from the plates. The particulate matter falls from the plate to the bottom of the electrostatic precipitator housing. A typical construction of a housing includes openings in the bottom thereof through which the collected particulate matter is removed from the housing for disposal.

It has been found that after prolonged usage of the precipitator, especially when hot gases flow through the precipitator, the plates lose their flatness in that they become warped or bent. This warping or bending of the plates has a deleterious effect on the effectiveness of the electrostatic precipitator. Typically, a given plate will warp or bend sufficiently so that the plate contacts one or more wire electrodes, thereby shorting out the wire electrodes and thus rendering the wire electrodes ineffective. Thus, particulate matter passing the wire electrodes is not charged by the wire electrodes. The uncharged particulate matter is not attracted to the plates so that the particulate matter is carried out of the housing rendering the precipitator ineffective.

There are a number of known devices for straightening plates once the plates have become warped or bent. U.S. Pat. No. 4,478,614, issued Oct. 23, 1984, to John A. Jonelis entitled, "Electrostatic Precipitator Construction Having Spacers" discloses several spacer constructions which are positioned between plates to straighten the plates. U.S. Pat. No. 4,479,813, issued Oct. 30, 1984, to John A. Jonelis entitled, "Electrostatic Precipitator Having Ladder Bar Spacers" discloses other spacers used for straightening warped or bent plates. U.S. Pat. No. 4,559,064, issued Dec. 17, 1985, to Anthony J. Ahern entitled, "Electrostatic Precipitator Having Spacers" teaches spacer constructions which are positioned between plates for straightening bent or warped plates. U.S. Pat. No. 4,647,296, issued Mar. 3, 1987, to Morris B. Tuck entitled, "Spacers For Straightening Warped Precipitator Curtains" teaches a spacer construction used for positioning a spacer between precipitator plates or curtains to straighten the plates. All of the aforementioned patents are directed to spacer constructions which are used between adjacent plates.

It has been found that the aforementioned spacers are most effective when the distance between adjacent plates has been decreased from the original spacing because the plates are bowed toward each other. When the last plate of a group of plates is bowed away from its adjacent plate and toward the housing, it is difficult to achieve an effective straightening of that last plate by utilization of the spacers which are designed for being positioned between adjacent plates. U.S. Pat. No. 4,007,023, issued Feb. 8, 1977, to Willi Batza, et al., entitled, "Electrostatic Precipitator With Collector-Electrode Spacers" is directed to an electrostatic precipitator construction wherein a spacer is disclosed for use with a housing wall and a plate; however, this spacer construction requires that the plate be spaced from a housing wall a given distance to be effective and does not lend itself to moving a plate from a wall. Batza's spacer construction is designed for inclusion when the electrostatic precipitator is originally built rather than installing spacers after the plates have become bent or warped.

There are a number of known constructions which show an electrostatic precipitator plate connected to a housing. One of such disclosures is U.S. Pat. No. 1,600,496, issued Sept. 21, 1926, to Weiskopf, entitled, "Apparatus For Electrical Precipitation Of Suspended Material From Gases". U.S. Pat. No. 2,036,323, which issued Apr. 7, 1936, to Engert, entitled, "Box Collecting Electrode For Electrical Precipitators" discloses a box construction having movable side walls. U.S. Pat. No. 2,195,431, which issued Apr. 2, 1940, to Shively et al, entitled, "Gas Treating Apparatus" discloses plates connected to a housing wall. U.S. Pat. No. 2,347,709, which issued May 2, 1944, to Penney, entitled, "Electrical Dust Precipitator" also discloses plates connected to a housing. U.S. Patent No. 2,705,221, which issued Mar. 29, 1955, to Clark et al, entitled, "Electric Filter" teaches a construction wherein the plates are connected to a housing. U.S. Pat. No. 3,086,341, which issued Apr. 23, 1963, to Brandt, entitled, "Shaking Device For Electric Filters And A Method For Operating Same" shows a construction wherein plates are connected to an anvil which is connected to a housing. U.S. Pat. No. 3,748,831, which issued July 31, 1973, to Lagerdahl et al., entitled, "Device For Electric Precipitator" discloses a device wherein plates are connected to a housing. U.S. Pat. No. 3,803,809, which issued Apr. 16, 1974, to Gelhaar et al, entitled, "Electrostatic Precipitator" teaches plates connected to the housing on the ends of the plates. British Publication No. 1,099,342, entitled, "Improvements in or relating to Electro-Precipitators" shows plates connected to the side wall but at the ends of the plates. None of the foregoing disclosures teaches or even suggests the concept of an adjustable buttress which engages a housing of an electrostatic precipitator and is used to move a bent or warped plate into its proper attitude thereby straightening the plate and to hold the plate in that position.

SUMMARY OF THE INVENTION

This invention relates to an adjustable buttress for use in an electrostatic precipitator for straightening and holding an end plate of a group of plates. The adjustable buttress is positioned between a portion of an electrostatic precipitator housing and an end plate of a plurality of plates within the housing. The adjustable buttress is placed into position and is adjusted so that the buttress rests against the housing and pushes the end plate which is warped or bent to an attitude wherein the portion of the end plate in contact with the adjustable buttress is moved into a selected position. The adjustable buttress includes an axle. A pair of buttress contacts is pivotally connected to the axle. The buttress contacts define a contact plane. Each of the buttress contacts is spaced from the axle so that the contact plane is spaced from the axle. A positioning device is connected to the buttress contacts for selectively moving the buttress contacts relative to each other. As the buttress contacts are moved toward each other, the contact plane is moved a greater distance from the axle. When the adjustable buttress is positioned between an end plate and a housing, movement of the buttress contacts toward each other causes the adjustable buttress to take up a greater space and thereby move the end plate away from the housing. The end plate then may be moved to a selected attitude.

DESCRIPTION OF THE PREFERRED EMBODIMENT

Figure 3:
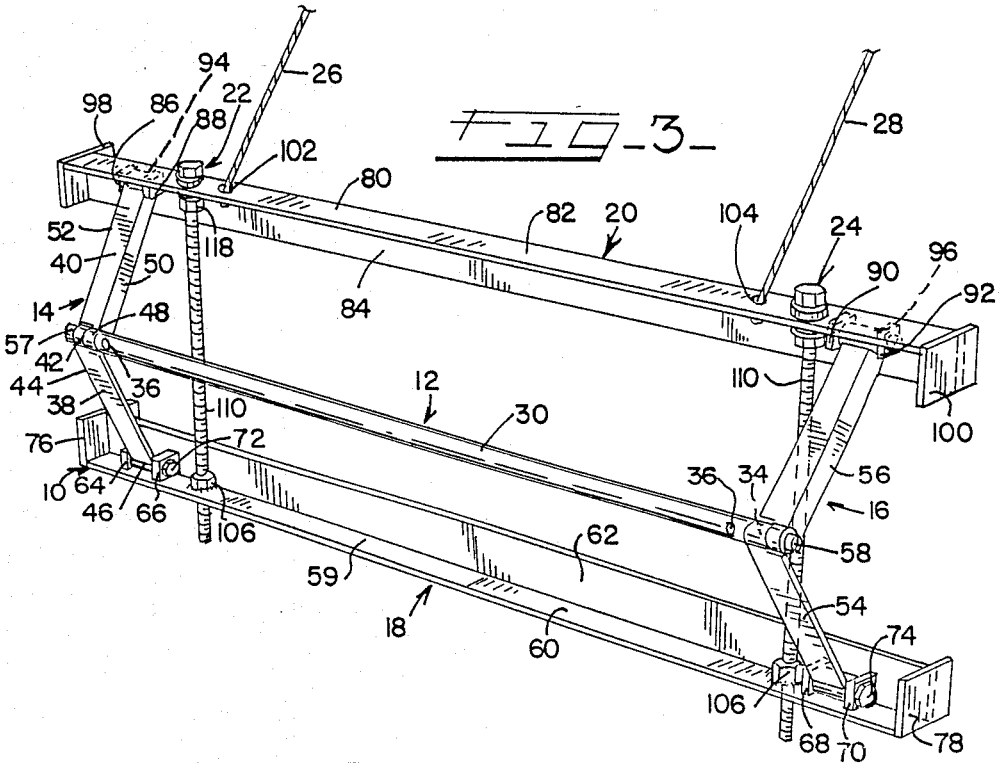
FIG. 3 is a perspective view of one of the adjustable buttresses shown in FIGS. 1 and 2 which buttresses embodying the herein disclosed invention.
Figure 6:
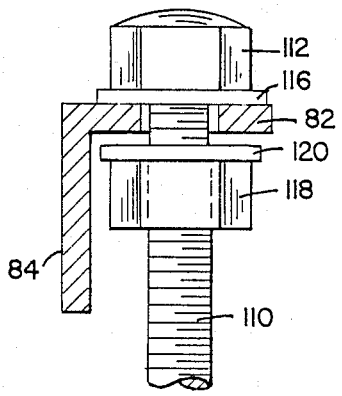
FIG. 6 is an enlarged fragmentary cross sectional view taken on Line 6—6 of FIG. 4.
Figure 7:
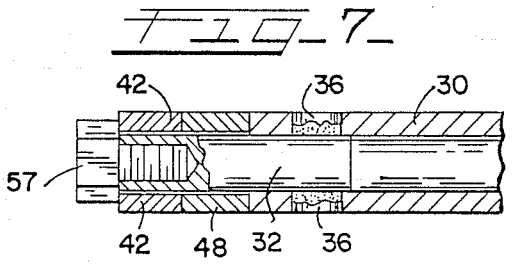
FIG. 7 is an enlarged cross sectional view taken on Line 7—7 of FIG. 4.
Figure 5:
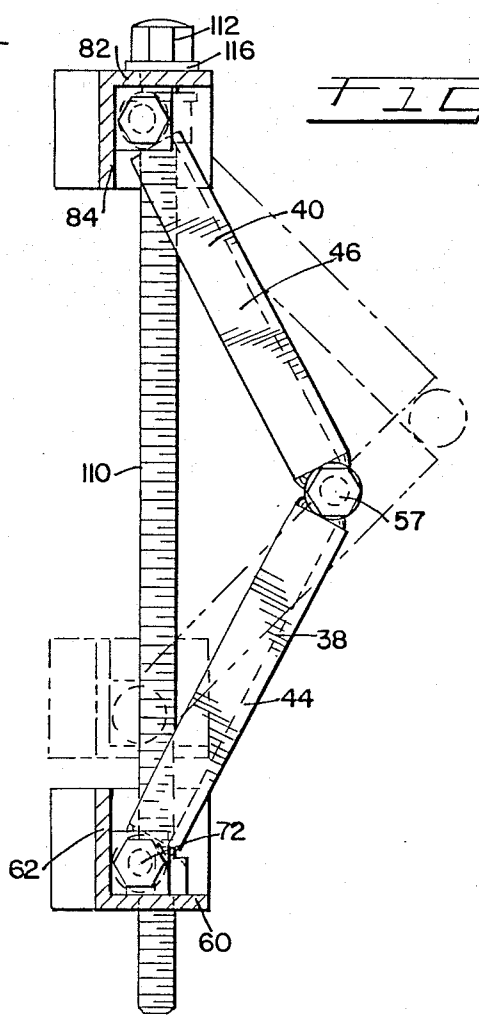
FIG. 5 is a cross sectional view taken on Line 5—5 of FIG. 4 and showing buttress contacts positioned closer to each other in phanthom view to show how the distance between an axle of the adjustable buttress and a plane of the buttress contacts is increased as the contacts are positioned closer to each other.
Figure 4:
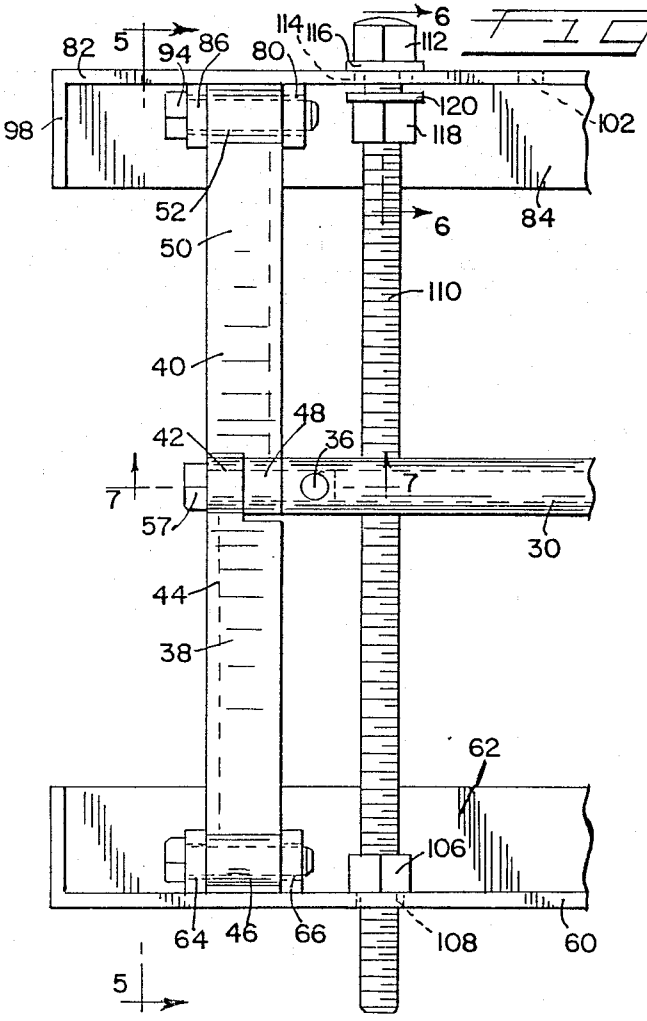
FIG. 4 is an enlarged fragmentary side elevational view of the adjustable buttress of FIG. 3.

Referring now to the drawings, and especially to FIG. 3, an adjustable buttress embodying the herein disclosed invention is shown therein and is generally indicated by numeral 10. The adjustable buttress generally includes an axle assembly 12. A first pair of arms 14 and a second pair of arms 16 are pivotally mounted on axle assembly 12. A lower rail assembly 18 is pivotally connected to one of each of the pairs of arms. An upper rail assembly 20 is pivotally connected to the other of each of the pairs of arms. A pair of positioning devices 22 and 24 is connected to the upper and lower rail assemblies. Conventional cables 26 and 28 are connected to the upper rail assembly at one end, and the other end of each of the cables is adapted for connection to a precipitator housing.

Axle assembly 12 includes a hollow axletree 30 with axle 32 mounted in one end and axle 34 mounted in the other end. Axles 32 and 34 are aligned so that each has a centerline which is in line with the centerline of the other axle. The axletree has two holes 36 opening to each of axles 32 and 34. Axles 32 and 34 are welded to the respective ends of the axletree through respective holes 36.

First pair of arms 14 includes a lower first arm 38 and an upper first arm 40. The lower first arm includes an axle bearing 42 which is pivotally mounted on axle 32. Arm 38 includes an elongated bar 44 which has one end connected to axle bearing 32. A pin bearing 46 is connected to the other end of bar 44.

Upper arm 40 is identical to lower arm 38 but is inverted in its connection to axle 32. Upper arm 40 includes an axle bearing 48 which is pivotally mounted on axle 32. Arm 40 includes an elongated bar 50 which has one end fixed to the axle bearing 48. A pin bearing 52 is fixed to the other end of bar 50.

Second pair of arms 16 includes a lower second arm 54 which is identical in construction to first arms 38 and 40. The other arm of arms 16 is upper second arm 56 which is also identical in construction to first arms 38 and 40. Arms 54 and 56 have axle bearings which are identical to axle bearings 42 and 48, respectively. The axle bearings of arms 54 and 56 are pivotally connected to axle 34.

Axle bearings 42 and 48 are locked onto axle 32 by a machine screw 57 which is threadedly mounted in axle 32. The axle bearings of arms 54 and 56 are held onto axle 34 by a like machine screw 58.

Lower arms 38 and 54 are pivotally connected to lower rail assembly 18. Lower rail assembly 18 includes a lower rail 59. Lower rail 59 is an angle iron having a horizontal flange 60 and an integral vertical flange 62. A pair of ears 64 and 66 is mounted on one end of horizontal flange 60, and a pair of identical ears 68 and 70 is mounted on the other end of flange 60. A pivot pin 72 is mounted in ears 64 and 66, and a like pivot pin 74 is mounted in ears 68 and 70. Pin bearing 46 of arm 38 is pivotally mounted on pivot pin 72, and the pin bearing of arm 54 is pivotally mounted on pivot pin 74 so that the lower rail assembly is pivotally connected to lower arms 38 and 54. The lower rail assembly includes a first lower buttress contact 76 which is welded to the one end of rail 59. A second buttress contact 78 is welded to the other end of rail 59.

Upper rail assembly 20 includes an upper rail 80 which is parallel to lower rail 59. Upper rail 80 is an angle iron including an upper horizontal flange 82 and an upper vertical flange 84 formed integral with horizontal flange 82. A pair of upper ears 86 and 88 is fixed to the upper horizontal flange adjacent to the one end of the flange, and a pair of upper ears 90 and 92 is fixed to the upper horizontal flange adjacent to the other end of the flange. A pivot pin 94 is mounted in ears 86 and 88, and a like pivot pin 96 is mounted in ears 90 and 92. Pin bearing 52 of upper arm 40 is pivotally mounted on pivot pin 94. The second upper arm 56 has its pin bearing pivotally mounted on pivot pin 96 so that the upper rail is pivotally connected to upper arms 40 and 56. A first upper buttress contact 98 is welded to the one end of rail 80, and a second upper buttress contact 100 is welded to the other end of rail 80. The upper horizontal flange 82 contains a pair of cable openings 102 and 104 which receive cables 26 and 28. The cables 26 and 28 have a conventional stop on the end of the cables to prevent the cables from pulling out of the openings 102 and 104, respectively.

Positioning device 22 includes a nut 106 which is welded to lower flange 60 and aligned with a lower flange first opening 108. An elongated threaded rod 110 threadedly engages nut 106 and extends through opening 108. The threaded rod has a conventional head 112 fixed to one end. Threaded rod 110 extends through an upper first opening 114 in horizontal flange 82. A washer 116 is positioned between head 112 and flange 82. A stop nut 118 is fixedly mounted on threaded rod 110 below horizontal flange 82 with a washer 120 positioned between nut 118 and the flange. Positioning device 24 is of a like construction to the above described positioning device 22, and the identical parts are identified by identical numbers.

Figure 2:
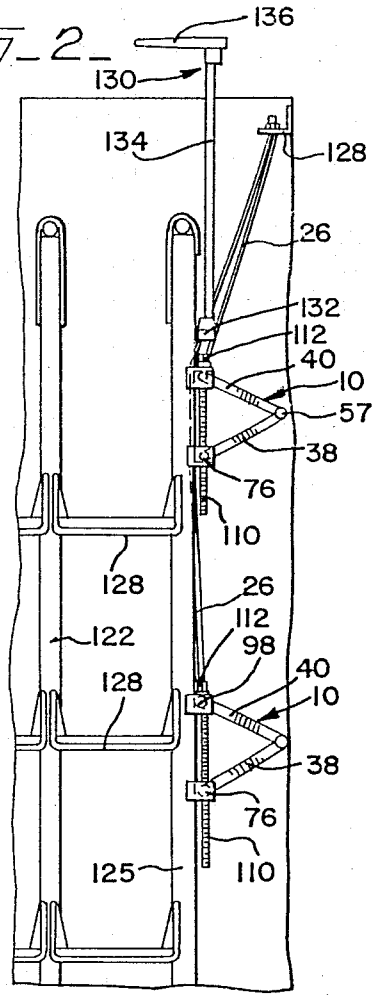
FIG. 2 is a fragmentary end view of a portion of the field of FIG. 1 showing a pair of vertically spaced adjustable buttresses in engagement with the housing and a portion of an end plate of the field of FIG. 1.
Figure 1:
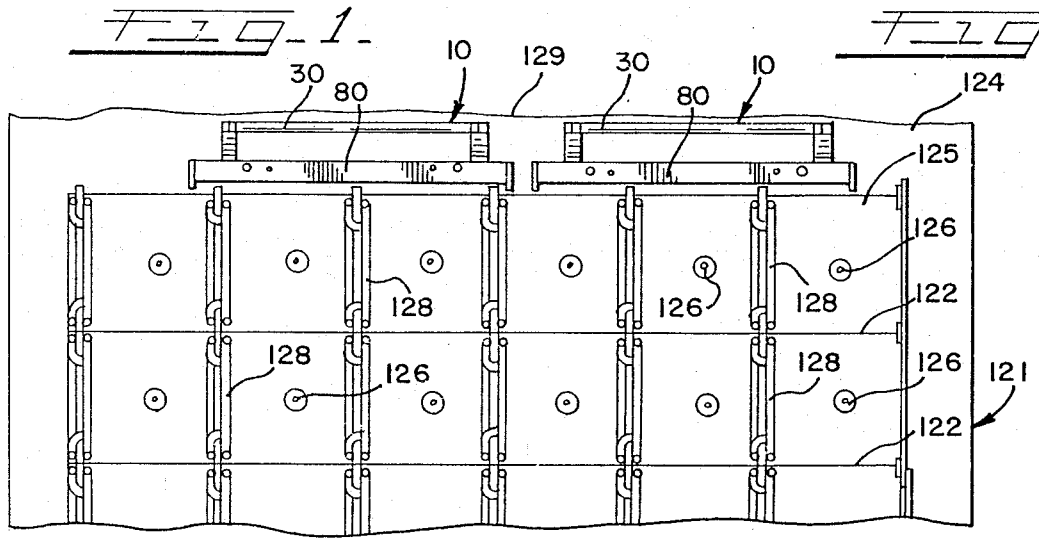
FIG. 1 is a plan view of a portion of a field of an electrostatic precipitator and a portion of a housing with a pair of horizontally spaced adjustable buttresses positioned between a end plate of the field and the housing.

Looking now to FIGS. 1 and 2, a typical electrostatic precipitator 121 is shown therein wherein a plurality of identical parallel plates 122 of a group of plates in a conventional field are shown mounted within a housing 124 with an end plate 125 adjacent to a wall of the housing. Conventional wire electrodes 126 are mounted between the plates. Spacers 128 are mounted between adjacent plates. The specific construction of spacers 126 is shown and described in detail in a patent application entitled, "Spacer Assembly For Use in Electrostatic Precipitator", Ser. No. 732,956, filed May 13, 1985, inventor being John A. Jonelis, one of the inventors herein. In the event that the last plate or end plate 125 of the group of electrostatic collector plates is bowed toward housing wall 129, one or more adjustable buttresses 10 is dropped between the plate and wall 129 on the same horizontal level. Cables 26 and 28 of the buttress are secured to a cable fastener 128 which is fixed to the housing wall, thereby positioning the adjustable buttress. A conventional and well known tool 130 is used to engage the axle assembly with the housing wall and the buttress contacts with the end plate to move the end plate away from the housing wall a selected distance. Tool 130 includes a socket 132 which engages conventionally head 112 of the positioning device. The socket is connected to an elongated shaft 134 which is in turn connected to a handle 136. An operator moves the handle 136 to rotate the shaft and thereby the head and threaded rod 110 to move the lower buttress contacts toward the respective upper buttress contacts of each of the adjustable buttresses. The buttress contacts form a contact plane. As the respective buttress contacts move toward each other the distance between the plane of the contacts and the axle assembly increases. The increase in distance causes the adjustable buttresses to push a portion of the end plate away from the housing wall. Cables 26 and 28 hold the adjustable buttresses in a selected position and the continued rotation of the positioning devices then moves the portion of the plate to a position where the portion is substantially aligned with the top of the plate. It may be appreciated that an additional pair of secondary adjustment buttresses may be dropped between the plate and the housing on a level above the first mentioned adjustable buttresses. The secondary adjustment buttresses are of the same construction as that mentioned above are positioned above the first mentioned adjustable buttresses so that the entire plate is substantially straightened. The secondary adjustment buttresses are also supported by cables secured to cable support 128.

Once the end plate is straightened, spacers 128 are inserted between the end plate and the next plate so that all of the plates in the cell are straightened. It is also possible to reverse the order in that spacers 128 may be first inserted and then the adjustment buttress added.

It may be appreciated that the adjustment buttresses may be placed into position and left there to hold the end plate in a selected attitude. It further may be appreciated that the buttresses may be used to correct a variety of bowing by the end plate. In the event that the end plate is bowed away from the housing, the buttresses may be adjusted to a proper spacing between the housing and the desired position of the end plate and the buttresses are then placed in position. The end plate is moved back into the desired position by the use of spacers. Once the adjustment buttresses are in position, the buttresses may be allowed to remain there indefinitely.

The specific description of the utilization of the instant adjustable buttress has taught the use of four adjustable buttresses together. The number of adjustable buttresses used may be varied in accordance with the requirements of a specific application depending upon the amount of warpage or bending of the end plate.

Although a specific embodiment of the herein disclosure has been shown in the accompanying drawings and described in detail above, it is readily apparent that those skilled in the art may make various modifications and changes without departing from the spirit and scope of the present invention. It is to be expressly understood that the instant invention is limited only by the appended claims.

We claim:

1. An adjustable buttress positioned between a portion of an electrostatic precipitator housing and an end plate being on one end of a plurality of plates for spacing the end plate from that portion of the housing comprising, in combination, an axle, a pair of buttress contacts pivotally connected to the axle, said buttress contacts defining a contact plane being substantially parallel to the end plate, each of said buttress contacts being spaced from the axle, and a positioning device connected to the buttress contacts for selectively moving the buttress contacts relative to each other to determine selectively the distance between the axle and the contact plane and thereby determine minimum spacing between the end plate and the portion of the housing.

2. An adjustable buttress as defined in claim 1, wherein the positioning device is an elongated threaded rod being threadedly connected to one of said buttress contacts.

3. An adjustable buttress as defined in claim 1, including, a rail connected to each of said buttress contacts, and a pair of elongated arms connected to each of said rails, each of said elongated arms having one end connected to its respective rail and the other end pivotally connected to the axle.

4. An adjustable buttress as defined in claim 1, including, a support connected to one of the buttress contacts, said support being connected to the electrostatic precipitator housing positioning the adjustable buttress relative to the electrostatic precipitator housing and the end plate.

5. An adjustable buttress as defined in claim 1, including, an elongated axletree having one end connected to the axle, a second axle connected to the other end of the axletree, and an elongated rail connected to each of said buttress contacts, each rail being pivotally connected to the first mentioned axle and the second axle.

6. An adjustable buttress as defined in claim 1, wherein said positioning device is an elongated threaded rod, said threaded rod being threadedly connected to one of said buttress contacts, said threaded rod being rotatably connected to the other of said buttress contacts and being held axially relative to the other of said buttress contacts.

7. An adjustable buttress as defined in claim 1, including, a cable having one end connected to one of the buttress contacts, said cable having its other end fixed relative to the electrostatic precipitator housing holding the adjustable buttress in a selected position relative to the electrostatic precipitator housing and the end plate.

8. An adjustable buttress as defined in claim 1, including a rail connected to each of said buttress contacts, a pair of elongated arms connected to each of said rails, each of said elongated arms having one end connected to its respective rail and the other end pivotally connected to the axle, said positioning device being an elongated threaded rod threadedly connected to one of said rails, and a second elongated threaded rod being threadedly connected to said one of said rails.

9. An adjustable buttress as defined in claim 1, wherein the positioning device is an elongated threaded rod threadedly connected to one of said buttress contacts, and including, a support connected to one of the buttress contacts, said support being connected to the electrostatic precipitator housing positioning the adjustable buttress relative to the electrostatic precipitator housing and the end plate.

10. An adjustable buttress as defined in claim 1, wherein the positioning device is an elongated threaded rod being threadedly connected to one of said buttress contacts, and including, an elongated axletree having one end connected to the axle, a second axle connected to the other end of the axletree, and an elongated rail connected to each of said buttress contacts, each rail being pivotally connected to the first mentioned axle and the second axle.

11. An adjustable buttress as defined in claim 1, including, a rail connected to each of said buttress contacts, a pair of elongated arms connected to each of said rails, each of said elongated arms having one end connected to its respective rail and the other end pivotally connected to the axle, and a support connected to one of the rails, said support connected to the electrostatic precipitator housing positioning the adjustable buttress relative to the electrostatic precipitator housing and the end plate.

12. An adjustable buttress as defined in claim 1, including, an elongated axletree having one end connected to the axle, a second axle connected to the other end of the axletree, a rail connected to each of said buttress contacts, and a pair of elongated arms connected to each of said axles, each of said arms having one end pivotally connected to its respective axle, each of said elongated arms having an opposite end connected to its respective rail.

13. An adjustable buttress as defined in claim 1, including, an elongated axletree having one end connected to the axle, a second axle connected to the other end of the axletree, each of said buttress contacts having an elongated rail connected thereto, each rail being pivotally connected to the first mentioned axle and the second axle, and a support connected to one of said elongated rails, said support being connected to the electrostatic precipitator housing positioning the adjustable buttress relative to the electrostatic precipitator housing and the end plate.

14. An adjustable buttress as defined in claim 1, including, each of said buttress contacts having a rail connected thereto, each of said rails having a pair of elongated arms connected thereto, each of said elongated arms having one end connected to its respective rail and the other end pivotally connected to the axle, wherein said positioning device is an elongated threaded rod being threadedly connected to one of said rails and being rotatably connected to the other of said rails, and a support connected to one of said rails, said support being connected to the electrostatic precipitator housing positioning the adjustable buttress relative to the electrostatic precipitator housing and the end plate.

15. An adjustable buttress as defined in claim 1, including, an elongated axletree having one end connected to the axle, a second axle connected to the other end of the axletree, each axle having a pair of elongated arms pivotally connected thereto, each of the elongated arms having one end pivotally connected to its respective axle, and an elongated rail connected to each of the buttress contacts, each elongated rail having the other end of a pair of elongated arms connected thereto, wherein the positioning device is a threaded rod being threadedly connected to one of said rails and being rotatably connected to the other of said rails.

16. An adjustable buttress as defined in claim 1, including, an elongated axletree having one end connected to the axle, a second axle connected to the other end of the axletree, said second axle being aligned with the first mentioned axle, each axle having a pair of elongated arms pivotally connected thereto, each of said elongated arms having one end pivotally connected to its respective axle, an elongated rail connected to each of said buttress contacts, each elongated rail being substantially parallel to the first mentioned axle, each rail being connected to a pair of elongated arms which arms are connected to different axles, and a support connected to one of said rails, said support being connected to the electrostatic precipitator housing positioning the adjustable buttress relative to the electrostatic precipitator housing and the end plate.

17. An adjustable buttress positioned between a portion of an electrostatic precipitator housing and an end plate being on one end of a plurality of plates for spacing the end plate from that portion of the housing comprising, in combination, an elongated axle, a pair of rails pivotally connected to the axle, said rails defining a plane being substantially parallel to said end plate, a positioning device connected to the rails for selectively spacing the rails relative to each other to select a given distance between the axle and the plane thereby determine the minimum spacing between the end plate and the portion of the housing, and a support connected to one of said rails, said support being connected to the electrostatic precipitator housing positioning the adjustable buttress relative to the electrostatic precipitator housing and the end plate.

18. An adjustable buttress as defined in claim 17, including, a pair of elongated arms connected to each of the rails, each of the arms being pivotally connected to the axle.

19. An adjustable buttress as defined in claim 17, including, a buttress contact fixed to each end of each of said rails, wherein the positioning device is an elongated threaded rod being threadedly connected to one of said rails and being rotatably connected to the other of said rails.

20. An adjustable buttress positioned between a portion of an electrostatic precipitator housing and an end plate being on one end of a plurality of plates for spacing the end plate from that portion of the housing comprising, in combination, an axletree, an axle mounted on each of a pair of opposed ends of the axletree, said axles being substantially aligned, a pair of axle bearings pivotally mounted on each of said axles, an elongated bar connected to each of said axle bearings, a pin bearing mounted on each elongated bar and being spaced from the respective axle bearing, a pivot pin rotatably connected to each pin bearing, a rail connected to each pair of spaced pivot pins, said rails being substantially parallel to each other and to the axles, a buttress contact fixed to each end of each rail, said buttress contacts defining a plane substantially parallel to the end plate, a pair of threaded rods rotatably mounted in one of said rails, each of said threaded rods being threadedly connected to the other said rails for selectively spacing the rails relative to each other thereby determine the minimum distance between the end plate and the portion of the housing, and a pair of cables connected to one of said rails, each of said cables having its other end connected to the electrostatic precipitator housing for positioning the adjustable buttress relative to the portion of the electrostatic precipitator housing and the end plate.

21. An adjustable buttress positioned between a portion of an electrostatic precipitator housing and an end plate being on one end of a plurality of plates for spacing the end plate from that portion of the housing comprising, in combination, a pair of elongated arms, each of said elongated arms being pivotally connected to the other arm at one end, a buttress contact fixed to the other end of each of the arms, and a positioning device connected to the arms for selectively moving the buttress contacts relative to each other to determine selectively the distance between a plane formed by the buttress contacts and the pivotal connection between the elongated arms for selectively adjusting the space between that portion of the housing and the end plate.

22. An adjustable buttress as defined in claim 21, including, a support connected to one of the arms, said support being connected to the electrostatic precipitator housing for positioning the adjustable buttress relative to the electrostatic precipitator housing and the end plate.

23. An adjustable buttress as defined in claim 21, wherein said positioning device is an elongated threaded rod being threadedly connected to one of said arms and being rotatably connected to the other of said arms.

24. An adjustable buttress as defined in claim 21, wherein said positioning device is an elongated threaded rod, said threaded rod being threadedly connected to one of said elongated arms and rotatably connected to the other of said threaded arms, and including a cable having one end connected to one of said elongated arms, said cable having its other end connected to the electrostatic precipitator housing for positioning the adjustable buttress relative to the electrostatic precipitator housing and the end plate.

* * * * *